US011265633B2

(12) United States Patent
Nagaoka

(10) Patent No.: US 11,265,633 B2
(45) Date of Patent: Mar. 1, 2022

(54) SPEAKER HOUSING

(71) Applicant: Hosiden Corporation, Yao (JP)

(72) Inventor: Satofumi Nagaoka, Yao (JP)

(73) Assignee: HOSIDEN CORPORATION, Yao (JP)

( * ) Notice: Subject to any disclaimer, the term of this patent is extended or adjusted under 35 U.S.C. 154(b) by 0 days.

(21) Appl. No.: 16/897,585

(22) Filed: Jun. 10, 2020

(65) Prior Publication Data

US 2021/0006878 A1 Jan. 7, 2021

(30) Foreign Application Priority Data

Jul. 1, 2019 (JP) ..... JP2019-123084

(51) Int. Cl.
*H04R 1/02* (2006.01)

(52) U.S. Cl.
CPC ..... *H04R 1/026* (2013.01); *H04R 2201/02* (2013.01)

(58) Field of Classification Search
CPC ..... H04R 1/28; H04R 1/2803; H04R 1/2807; H04R 1/2811; H04R 1/2869; H04R 1/2873; H04R 1/2884; H04R 1/2888; H04R 2201/029; H04R 3/04
See application file for complete search history.

(56) References Cited

U.S. PATENT DOCUMENTS

| | | | |
|---|---|---|---|
| 3,687,221 | A | 8/1972 | Bonnard |
| 3,688,011 | A | 8/1972 | Yamamoto |
| 2014/0193026 | A1 | 7/2014 | Ajiki et al. |
| 2015/0319523 | A1 | 11/2015 | Kano et al. |

FOREIGN PATENT DOCUMENTS

| | | | |
|---|---|---|---|
| EP | 2941012 | A2 | 11/2015 |
| WO | 2013/190824 | | 12/2013 |

OTHER PUBLICATIONS

European Search Report dated Nov. 26, 2020, 5 pages.

*Primary Examiner* — Kile O Blair
(74) *Attorney, Agent, or Firm* — Rankin, Hill & Clark LLP

(57) ABSTRACT

A speaker housing of the present invention is a speaker housing for housing a speaker unit, wherein a first rib and/or a second rib whose distance from the speaker unit continuously changes is provided inside the speaker housing, so that the distance from the speaker unit to the first rib and/or the second rib is not constant, resonance is dispersed, no remarkable resonance occurs, and deterioration of distortion can be reduced.

3 Claims, 5 Drawing Sheets

SPEAKER HOUSING

BACKGROUND OF THE INVENTION

(1) Field of the Invention

The present invention relates to a speaker housing for housing a speaker unit.

(2) Description of Related Art

In a speaker system, vibration of units produces sounds, and the sounds are transmitted to the enclosure and produce unnecessary sounds. In some cases, a rib is provided on a speaker housing to reduce distortion without increasing the thickness and weight of the speaker housing. In such cases, when a concentric rib, such as a reinforcing rib 26F provided on a frame in Japanese Translation of PCT Republication WO 2013/190824 A1, centered on the center of a speaker unit is provided, there arises a problem that the distance from the unit to the rib is constant, resonance is concentrated on a constant frequency, and distortion is deteriorated.

SUMMARY OF THE INVENTION

An object of the present invention is to provide a speaker housing capable of reducing deterioration of distortion.

To achieve the above object, a speaker housing of the present invention is a speaker housing for housing a speaker unit, wherein a rib whose distance from the speaker unit continuously changes is provided inside the speaker housing.

Regarding the speaker housing of the present invention, it is preferable that the speaker housing has a housing body and a bottom plate, the speaker unit is provided between the housing body and the bottom plate, and the rib is provided on one or both of the speaker main body and the bottom plate.

Regarding the speaker housing of the present invention, it is also preferable that the rib is provided in a spiral shape around the speaker unit.

According to a speaker housing of the present invention that is a speaker housing for housing a speaker unit, a rib whose distance from the speaker unit continuously changes is provided inside the speaker housing, so that the distance from the speaker unit to the rib is not constant, resonance is dispersed, no remarkable resonance occurs, and deterioration of distortion can be reduced.

DETAILED DESCRIPTION OF PREFERRED EMBODIMENTS

Figure 1:
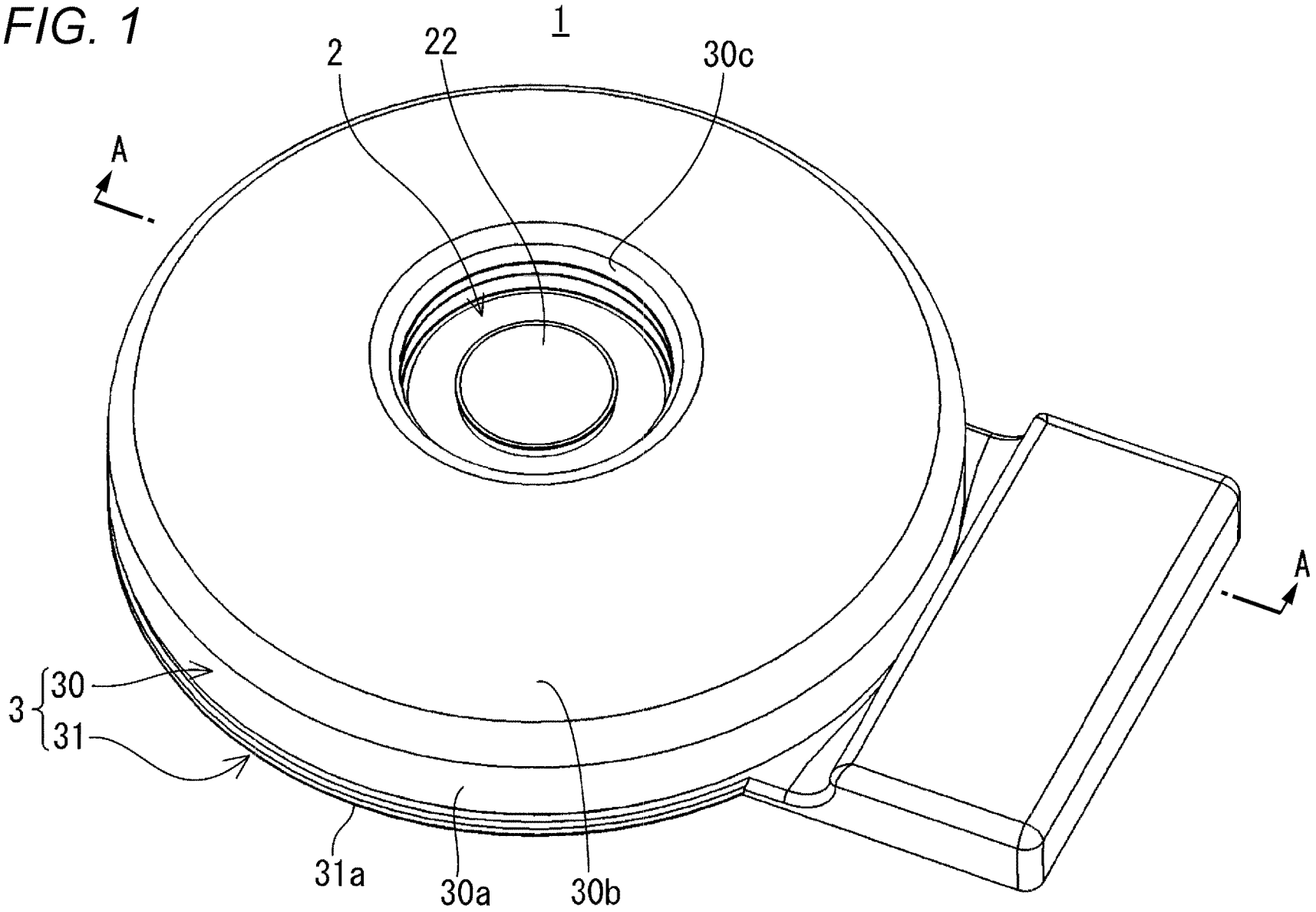
FIG. 1 is a perspective view of a speaker system illustrating an embodiment of the present invention.
Figure 2:
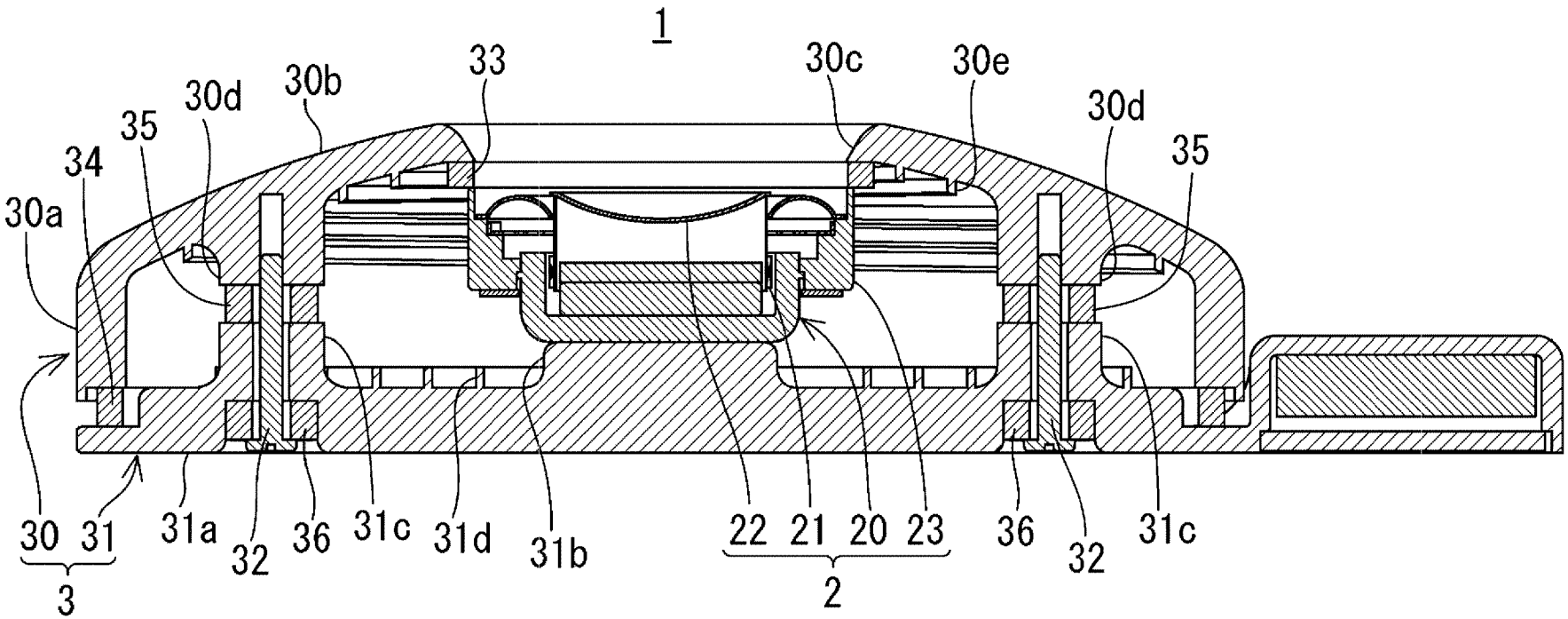
FIG. 2 is a sectional view taken along line A-A of FIG. 1.
Figure 3:
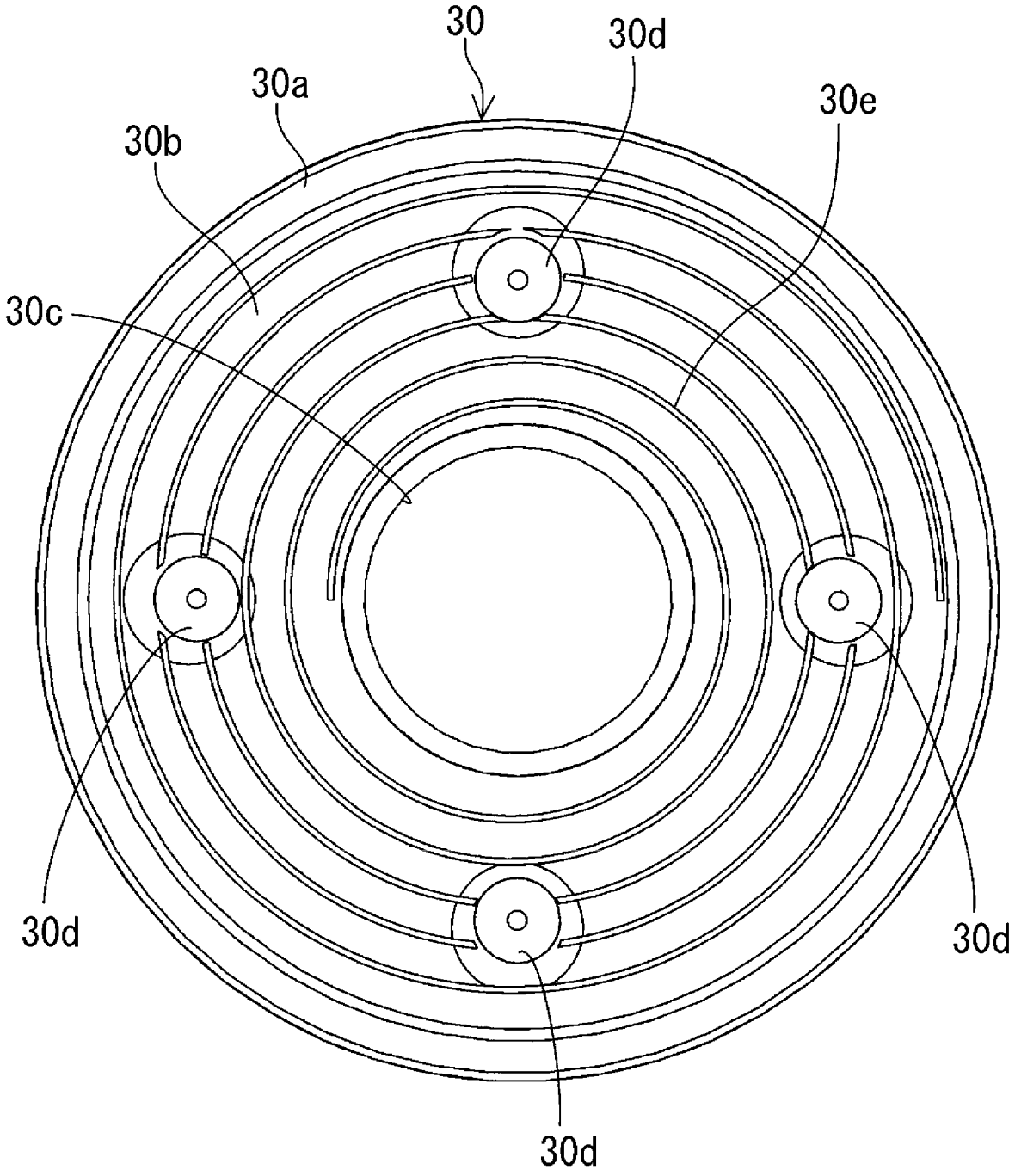
FIG. 3 is a bottom view of a housing body.
Figure 4:
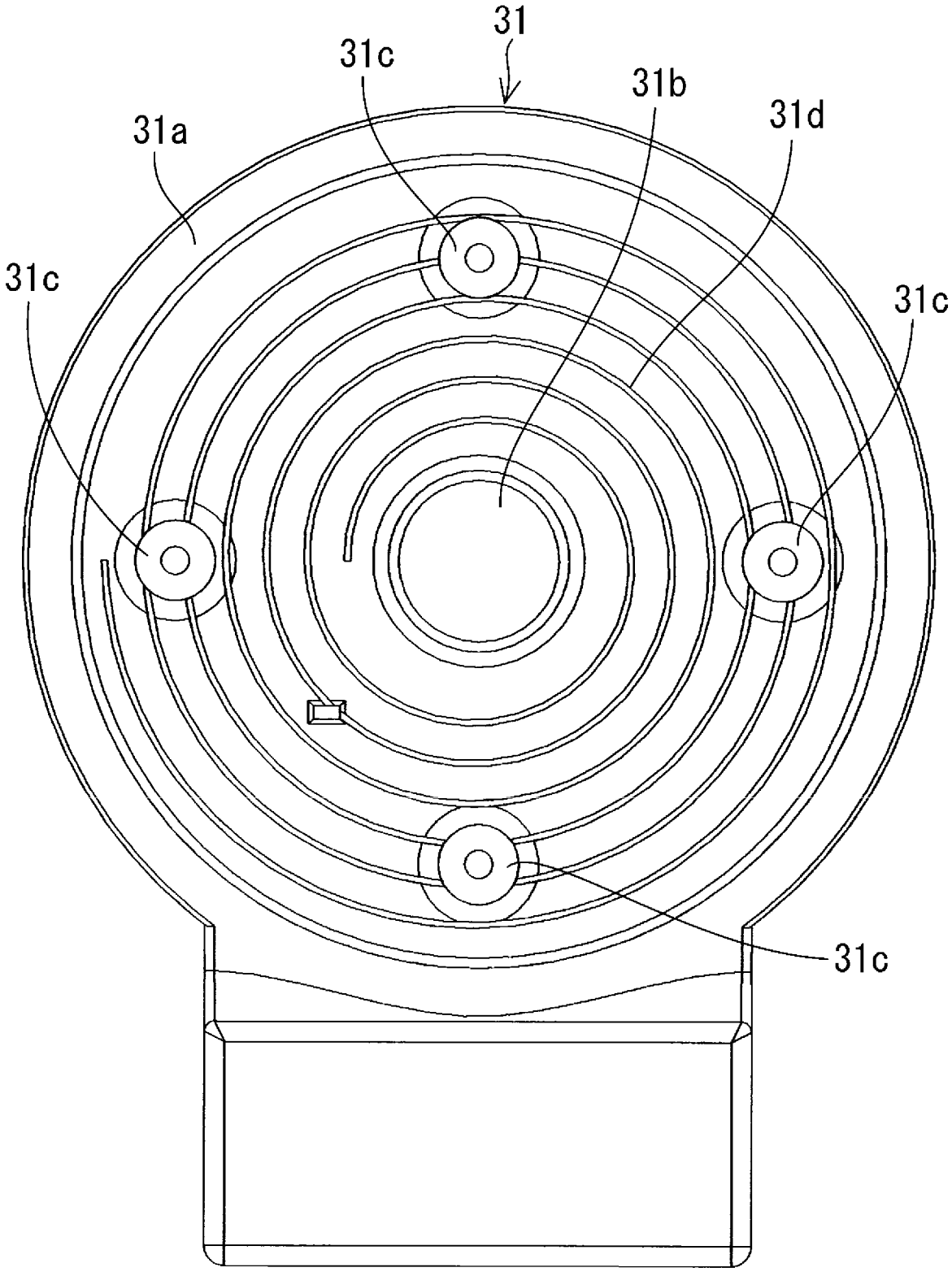
FIG. 4 is a plan view of a bottom plate.

Hereinafter, an embodiment of the present invention will be described with reference to the drawings. FIG. 1 is a perspective view of a speaker system including a speaker housing according to an embodiment of the present invention. FIG. 2 is a sectional view taken along line A-A of FIG. 1. FIG. 3 is a bottom view of a housing body. FIG. 4 is a front view of a bottom plate.

As illustrated in FIGS. 1 and 2, a speaker system 1 includes a speaker unit 2 that converts electricity into sound, and a speaker housing 3 that houses the speaker unit 2.

The speaker unit 2 is of an electrodynamic type and includes a magnetic circuit 20, a voice coil 21, a diaphragm 22, and a frame 23 that supports a drive system (the magnetic circuit 20) and a vibration system (the voice coil 21 and the diaphragm 22) and couples these systems to each other, so that the vibration system vibrates vertically and emits sound when a drive current is passed through the voice coil 21.

The speaker unit 2 is circular, and the magnetic circuit 20, the voice coil 21, the diaphragm 22, and the frame 23 each have a circular shape and are assembled with centers thereof located at the same position.

As illustrated in FIGS. 1 to 4, the speaker housing 3 includes a housing body 30 and a bottom plate 31, each of which is formed by molding synthetic resin.

The housing body 30 includes a low-profile cylindrical trunk 30*a*, and a dome-shaped baffle portion 30*b* that covers an upper opening of the trunk 30*a*, a circular opening 30*c* is concentrically provided at a center portion of the baffle portion 30*b*, and a plurality of bosses 30*d* protruding downward are provided at equal intervals on a lower surface of the baffle portion 30*b* around the opening 30*c*.

The bottom plate 31 includes a disk portion 31*a* that covers a lower opening of the trunk 30*a* of the housing body 30, a column-shaped stand 31*b* protruding upward is concentrically provided at a center portion of an upper surface of the disk portion 31*a*, and a plurality of bosses 31*c* protruding upward are provided at equal intervals on an upper surface of the disk portion 31*a* around the stand 31*b*.

In the above configuration, the speaker unit 2 is sandwiched between the housing body 30 and the bottom plate 31, and the housing body 30 and the bottom plate 31 are fastened with a plurality of screws 32 with centers of the speaker unit 2, the housing body 30, and the bottom plate 31, or more specifically centers of the vibration system of the speaker unit 2, the baffle portion 30*b* of the housing body 30, and the disk portion 31*a* of the bottom plate 31 located at the same position, so that the disk-shaped speaker housing 3 is assembled with the speaker unit 2 housed and held inside, and the speaker system 1 is configured.

In such a state, the speaker unit 2 is placed on the stand 31*b* of the bottom plate 31, and the housing body 30 is put on the disk portion 31*a* of the bottom plate 31, so that the opening 30*c* of the baffle portion 30*b* of the housing body 30 faces the diaphragm 22 of the speaker unit 2, an inner peripheral edge portion (an edge portion of the opening 30*c*) of the baffle portion 30*b* of the housing body 30 faces an upper end portion of the frame 23 of the speaker unit 2, and an annular gasket 33 made of an elastic material such as rubber is sandwiched between the inner peripheral edge portion of the baffle portion 30*b* of the housing body 30 and the upper end portion of the frame 23 of the speaker unit 2 that face each other.

Moreover, a lower end portion of the trunk 30*a* of the housing body 30 faces an outer peripheral edge portion of the disk portion 31*a* of the bottom plate 31, and an annular gasket 34 made of an elastic material such as rubber is sandwiched between the outer peripheral edge portion of the disk portion 31*a* of the bottom plate 31 and the lower end portion of the trunk 30*a* of the housing body 30 that face each other.

Further, a lower end portion of each boss 30*d* of the baffle portion 30*b* of the housing body 30 faces an upper end portion of each boss 31*c* of the disk portion 31*a* of the bottom plate 31, and a cylindrical elastic body 35 made of an elastic material such as rubber is sandwiched between an upper end portion of each boss 31*c* of the disk portion 31*a* of the bottom plate 31 and a lower end portion of each boss 30*d* of the baffle portion 30*b* of the housing body 30 that face each other.

Furthermore, a screw 32 is inserted into each boss 31*c* of the disk portion 31*a* of the bottom plate 31 from the lower surface side of the bottom plate 31, inserted into the elastic body 35, and screwed into and fastened to each boss 30*d* of the baffle portion 30*b* of the housing body 30.

Moreover, a cylindrical elastic body 36 made of an elastic material such as rubber and also serving as a seal is sandwiched between a head portion of each screw 32 and the bottom plate 31.

In addition, as illustrated in FIGS. 2 and 3, a first rib 30*e* that has a plate-like cross-sectional shape and protrudes downward from a lower surface of the baffle portion 30*b* around the opening 30*c* of the housing body 30 is provided in a spiral shape around the center of the speaker unit 2, more specifically, the center of the vibration system of the speaker unit 2, and a rib that is a core configuration of the present invention is provided to reduce distortion without increasing the thickness and weight of the speaker housing 3. That is, a rib whose distance from the speaker unit 2 continuously changes is provided inside the speaker housing 3.

Furthermore, as illustrated in FIGS. 2 and 4, a second rib 31*d* that has a plate-like cross-sectional shape and protrudes upward from an upper surface of the disk portion 31*a* around the stand 31*b* of the bottom plate 31 is provided in a spiral shape around the center of the speaker unit 2, or more specifically the center of the vibration system of the speaker unit 2, and a rib that is a core configuration of the present invention is provided to reduce distortion without increasing the thickness and weight of the speaker housing 3. That is, a rib whose distance from the speaker unit 2 continuously changes is provided inside the speaker housing 3.

Figure 5:
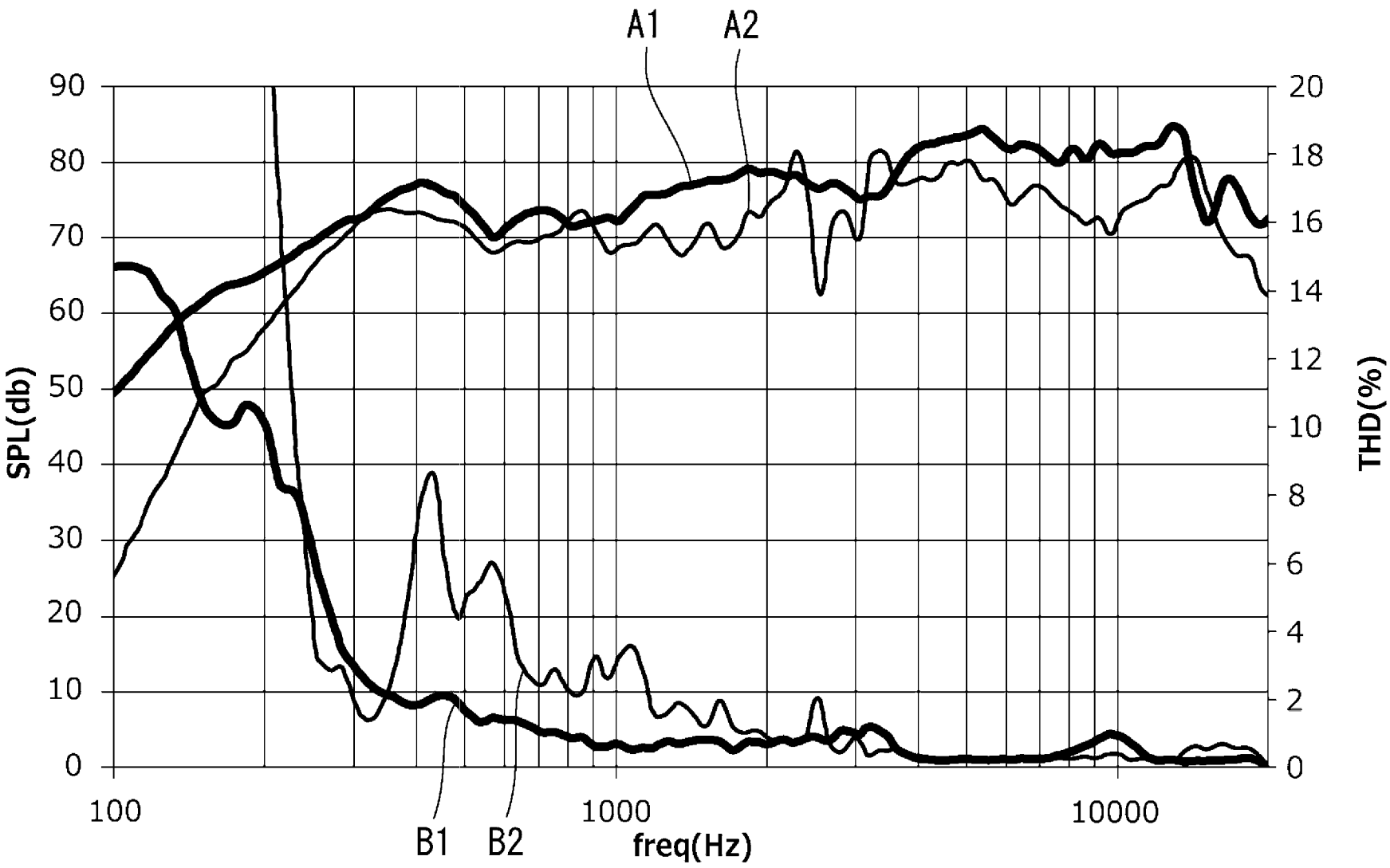
FIG. 5 is a frequency characteristic diagram.

FIG. 5 illustrates the frequency characteristics of the speaker system 1 of the present embodiment and a conventional speaker system (not shown). In FIG. 5, A1 represents the sound pressure frequency characteristic of the speaker system 1 of the present embodiment, A2 represents the sound pressure frequency characteristic of the conventional speaker system, B1 represents the distortion factor frequency characteristic of the speaker system 1 of the present embodiment, and B2 represents the distortion factor frequency characteristic of the conventional speaker system.

The conventional speaker system has the same structure as that of the speaker system 1 of the present embodiment except that a third rib and a fourth rib are provided instead of the first rib 30*e* and the second rib 31*d* in the speaker system 1 of the present embodiment. The third rib is a rib that has a plate-like cross-sectional shape and protrudes downward from a lower surface of a baffle portion 30*b* around an opening 30*c* of a housing body 30 in a conventional speaker system, and is concentrically provided to be centered on the center of a speaker unit 2, or more specifically the center of a vibration system of the speaker unit 2. The fourth rib is a rib that has a plate-like cross-sectional shape and protrudes upward from an upper surface of a disk portion 31*a* around a stand 31*b* of a bottom plate 31 in the conventional speaker system, and is concentrically provided to be centered on the center of the speaker unit 2, or more specifically the center of the vibration system of the speaker unit 2.

The sound pressure frequency characteristic A2 of a conventional speaker system has a steep dip between 2 kHz and 3 kHz, because the speaker housing 3 of the conventional speaker system is provided with the third and fourth ribs centered on the center of the vibration system of the speaker unit 2, so that the distance from the speaker unit 2 to each rib is constant, and resonance is concentrated on a constant frequency. The distortion factor frequency characteristic B2 of the conventional speaker system also has a peak in the distortion factor at the same frequency. It can also be seen that there are peaks in the distortion factor at other frequencies.

On the other hand, it can be seen that the sound pressure frequency characteristic A1 of the speaker system 1 of the present embodiment has a gentle curve, and has no extreme peak dip and no strong resonance. It can also be seen that the distortion factor frequency characteristic B1 of the speaker system 1 of the present embodiment has no extreme peak dip and no strong resonance. This is considered because the speaker housing 3 of the speaker system 1 of the present embodiment is provided with the first rib 30*e* and the second rib 31*d* whose distance from the speaker unit 2 continuously changes, and more specifically, the first rib 30*e* and the second rib 31*d*, are provided in a spiral shape around the speaker unit 2, so that the distance from the speaker unit 2 to each of the ribs 30*e* and 31*d* is not constant, and resonance is dispersed.

As described above, the speaker housing 3 of the speaker system 1 of the present embodiment is a speaker housing 3 for housing a speaker unit 2, wherein a first rib 30*e* and a second rib 31*d* whose distance from the speaker unit 2 continuously changes are provided inside the speaker housing 3, so that the distance from the speaker unit 2 to the first rib 30*e* and the second rib 31*d* is not constant, resonance is dispersed, no remarkable resonance occurs, and deterioration of distortion can be reduced.

Although ribs whose distance from the speaker unit 2 continuously changes are provided on both of the housing body 30 and the bottom plate 31 constituting the outer shell of the speaker housing 3 in the present embodiment, it is to be noted that a rib whose distance from the speaker unit 2 continuously changes may be provided any one of the housing body 30 and the bottom plate 31.

DESCRIPTION OF REFERENCE NUMERALS

2: speaker unit; 3: speaker housing; 30*e*: first rib; 31*d*: second rib

What is claimed is:

1. A speaker housing for housing a speaker unit, wherein a first rib and a second rib are each provided in a spiral shape around the speaker unit, and whose distances from the speaker unit continuously changes, and are provided inside the speaker housing, and wherein the speaker housing has a housing body and a bottom plate, the speaker unit is provided between the housing body and the bottom plate, and the first rib is provided on the housing body and the second rib is provided on the bottom plate.

2. The speaker housing according to claim 1, wherein:

the housing body includes a cylindrical trunk and a dome-shaped baffle portion that covers an upper opening of the trunk, a circular opening is concentrically provided at a center portion of the baffle portion, and the first rib has a plate-like cross-sectional shape, protrudes downward from a lower surface of the baffle portion around the circular opening, and is provided in the spiral shape around a center of the speaker unit.

3. The speaker housing according to claim 2, wherein:

the bottom plate includes a disk portion that covers a lower opening of the trunk of the housing body, a column-shaped stand protrudes upward and is concentrically provided at a center portion of an upper surface of the disk portion, and the second rib has a plate-like cross-sectional shape, protrudes upward from the upper surface of the disk portion around the stand of the bottom plate, and is provided in the spiral shape around the center of the speaker unit.

* * * * *